United States Patent [19]

Baker

[11] 3,934,405

[45] Jan. 27, 1976

[54] ROTATABLE TRANSPARENT DISC SECOND HAND FOR WATCH

[76] Inventor: Ronald P. Baker, 5676 Broadview Road, Parma, Ohio 44134

[22] Filed: Dec. 23, 1974

[21] Appl. No.: 535,946

[52] U.S. Cl. ..... 58/126 A; 58/90 R
[51] Int. Cl.[2] ..... G04B 19/00; G04B 37/08
[58] Field of Search ..... 58/90 R, 125 B, 126 RA, 58/127 R

[56] References Cited

UNITED STATES PATENTS

| | | | |
|---|---|---|---|
| 2,976,674 | 3/1961 | Haydon | 58/126 R |
| 3,162,008 | 12/1964 | Berger et al. | 58/126 R |
| 3,183,659 | 5/1965 | Etienne | 58/125 R |
| 3,763,648 | 10/1973 | Pakter et al. | 58/127 R |

*Primary Examiner*—Edith Simmons Jackmon
*Attorney, Agent, or Firm*—Alfred D. Lobo

[57] ABSTRACT

A timepiece is disclosed which has a single transparent disc coaxially mounted within a case. The disc which carries a reference mark serves as a rotatable second hand. The disc is mounted on a central spindle in a unique manner for optimum balance and trouble-free operation.

4 Claims, 4 Drawing Figures

ROTATABLE TRANSPARENT DISC SECOND HAND FOR WATCH

BACKGROUND OF THE INVENTION

This invention relates to timepieces, and more particularly to wrist watches having conventional hour-indicating and minute-indicating radial arms or hands, and additionally, a second-indicating means disposed above the hour and minute-indicating hands. Conventionally, the second-indicating means is also a hand which generally is at least as long as and lighter in weight than the minute hand, which in turn is longer and lighter in weight than the hour hand. The second hand is long and slender because it is essential that the second hand have relatively low mass to maintain the precision to which the delicate mechanism of a conventional watch is dedicated.

Recently it has become desirable to use rotatable disc members instead of the conventional hands of clocks and watches. This use of rotatable disc members is in part due to the dictates of fashion but is also due, in large measure, to the greater visual impact of the rotating reference characters or indiciae on the disc members. Particularly in poor light conditions the reference character on a rotatable disc is much easier to see than a slender second hand. Thus, a timepiece having three rotatable transparent discs mounted coaxially within a case, beneath a graticule marked on the surface of the cover glass, is described in U.S. Pat. No. 3,665,702. Still another timepiece utilizing color-graduated discs is disclosed in U.S. Pat. No. 3,803,831, and it is stated therein that disc members are preferable to watch hands because watch hands are more often than not quite fragile, particularly the second hand. This particular fragility of the second hand, and its proclivity to be deleteriously affected by even the minimal presence of foreign material in the form of fine particles of dust is also alluded to in U.S. Pat. No. 2,976,674 which describes an open-face clock. In this clock the second hand is sealed in an enclosure designed to isolate the annular space between the surface of the spindle on which the second hand is mounted and the inner surface of the tubular member in which the spindle turns.

The same problem of maintaining a clean annular space between the central spindle for the second hand and a surrounding spindle for the minute hand exists in a conventional wrist watch, except of course to a lesser degree because of the protective cover member or cover glass on a wrist watch. However, as is well known in the art, moisture and microscopic dust particles nevertheless do find their way into a watch casing. This disconcerting inability to completely seal a watch casing with a cover glass is commonly attributed to the observation that a watch "breathes" as part of the physical process by which it establishes and adjusts its equilibrium with the conditions of the surrounding atmosphere.

Thus the combination of the relatively large mass of a rotatable disc member substantially the same diameter as that of the face of the watch and the deleterious effect of dust in the annular space between the central spindle on which the second-indicating means is to be mounted, has made it most difficult to provide a reliable rotating second-indicating disc member for a wrist watch. As is well known a watch removably disposed on a person's wrist is subject to many disruptive movements and it is particularly difficult to provide a mounting means for a second-indicating disc member which mounting means can effectively negate such disruptive movements. The second-indicating disc member of this invention mounted in the unique manner to be described more fully hereinafter, provides a solution to the problem.

SUMMARY OF THE INVENTION

It is therefore a general object of this invention to provide a timepiece having conventional minute-indicating and hour-indicating hands with a rotatable disc member having an easily read reference mark which replaces a conventional second-indicating hand.

It is also a general object of this invention to provide a transparent second-indicating disc member having substantially the same diameter as the face of the timepiece, the disc being coaxially mounted in spaced apart relationship with the face of the timepiece and the minute and hour-indicating hands, for revolution at the rate of 1 revolution per minute.

It is a specific object of this invention to provide a transparent second-indicating disc, having several times larger mass than a conventional second hand, fixedly attached to a metal mounting member which is fixedly disposed on a rotatable central spindle about which a first hollow shaft for a minute hand, and a second hollow shaft for an hour hand are disposed.

It is also a specific object of this invention to provide a rugged mounting assembly for a second-indicating rotatable disc wherein the metal mounting member for the disc is journalled for slight frictional engagement with the inner surface of a first hollow shaft so as to provide a dual function, namely, (a) providing a bearing surface for optimum balance and stability and, (b) sealing out dust and moisture from around the central spindle.

BRIEF DESCRIPTION OF THE DRAWINGS

The invention may best be understood by reference to the following description when taken in conjunction with the accompanying drawing in which.

DETAILED DESCRIPTION OF A PREFERRED EMBODIMENT OF THE INVENTION

Figure 1:
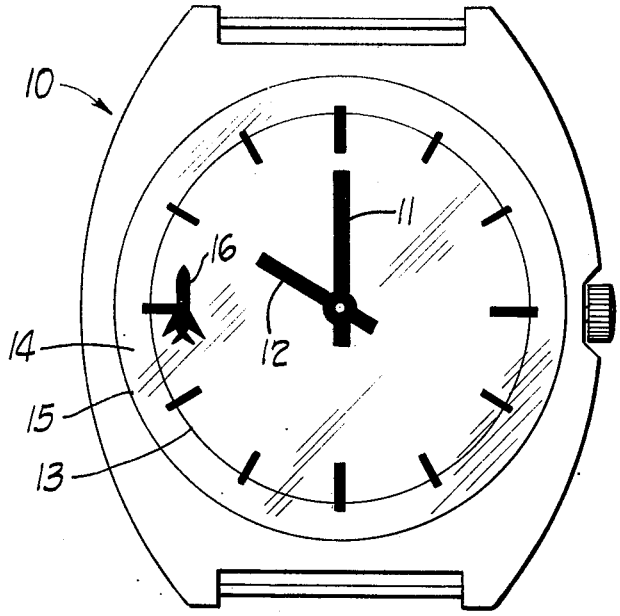
FIG. 1 is a top plan view of a timepiece showing a second-indicating rotatable disc member through which conventional minute and hour-indicating hands may be seen.
Figure 3:
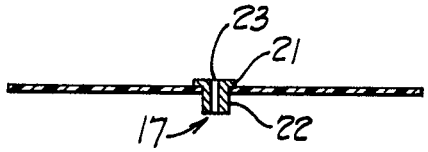
FIG. 3 is an elevation cross-section view of the transparent second-indicating rotatable disc member along the line 3—3 of FIG. 2.

As shown in FIG. 1, a timepiece indicated generally at 10, in the form of a wrist watch has conventional hands 11 and 12 for indicating minutes and hours respectively, but the seconds are indicated by a transparent disc member 13. The time-indicating members are arranged for rotation about a central axis, one above the other above the dial face 14, the disc 13 being uppermost, the hour hand being lowermost and the minute hand lying between the hour hand and the disc member. By transparent is meant that the disc is made of a material which is essentially completely permeable to visible light, and through which the hands 11 and 12 may be easily seen. It is preferred to make the disc 13 of a colorless plastic material of even thickness. The thickness of the disc is not critical but it should be chosen so that the periphery of the disc will not sag. A preferred thickness is in the range from about 0.010 to about 0.020 inch thick. A transparent protective cover member 15 covers the dial face 14 and the time-indicating members 11, 12 and 15. The visual effect is that of an invisibly supported indicia disposed above the watch hands.

Figure 2:
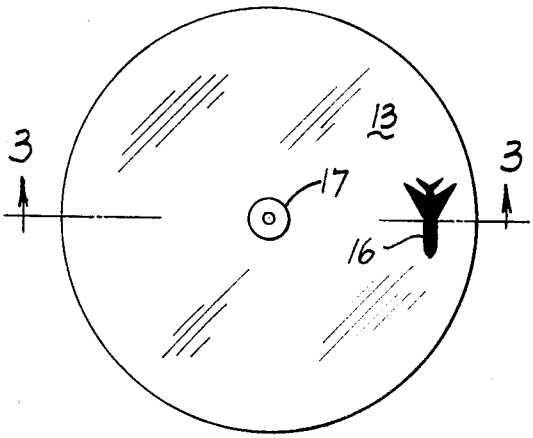
FIG. 2 is a top plan view of the transparent second-indicating rotatable disc member.

Referring now to FIG. 2 there is shown a plan view of the disc member 13 which carries a reference mark imprinted on the plastic near the periphery. The reference mark is preferably relatively large so that it is easily seen. For even greater visibility in poor light the reference mark may be outlined in light-sensitive or light-reflective pigments such as are well-known in the art as phosphorescent or luminescent coatings. The mark is preferably pointed, as is the nose of the airplane illustrated, or has an edge which may be aligned with any division mark on the dial. The reference mark shown is an outline of an aircraft and it will be apparent that a large reference mark such as this will be easy to read at a glance. Of course, any other indicia may be used provided, of course, that it is easy to read. The disc 13 has a central passage in which a metal mounting member or collar 17 is fixedly disposed.

The mounting member or collar 17 is provided with a radially outwardly extending flange portion 21 and a hub portion 22 having an axial passage 23. The axial passage 23 has a diameter chosen so as to tightly engage a central spindle 31 which has a diameter in the range from about 0.009 to about 0.015 inch. The outside diameter of the hub 22 is such that the disc 13 is frictionally disposed on the hub by way of an interference fit, and the upper surface of the disc abuts the flange portion 21.

Figure 4:
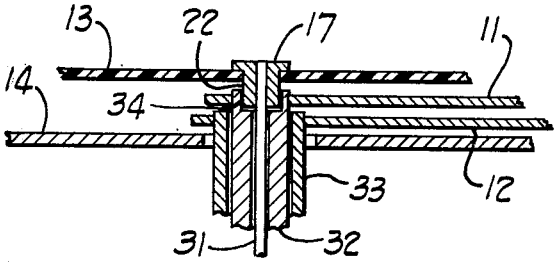
FIG. 4 is an elevation cross-section view of the upper portion of the mounting assembly for the second, minute and hour-indicating members.

Referring further to FIG. 4 there is shown the spindle 13 axially vertically disposed in hollow drive shafts 32 and 33 on which are disposed the conventional minute and hour-indicating hands 11 and 12, respectively. The hollow shafts 32 and 33 are rotatably mounted within the timepiece 10, extending vertically outward from the dial face 14, as is the spindle 31. The mechanism for selectively rotating the spindle 31 and shafts 32 and 33 is not shown since it forms no part of the present invention, and further, is conventional in any clock or watch, and accordingly will readily be understood by those skilled in the art.

The shaft 32 is rotatably disposed about the rotatable central spindle 31 without there being any circumferential contact of the surfaces. The shaft 32 is countersunk with an axial recess 34. The depth of the countersunk recess 34 is not critical but the diameter is. The diameter of the recess 34 is so chosen as to slightly frictionally engage the outer surface of the hub 22. Thus the inner vertical surface of the recess 34 provides a bearing surface for the hub 22, so as to provide optimum balance for the relatively heavy disc fixedly disposed on the hub. In particular this disposition of the collar 17 in the recess 34 provides differentially rotatable surfaces, and since the surface of the hub 22 rotates sixty times faster than the shaft 32, there is a dynamic stabilization of the rotational movement of the disc 13 relative to that of the minute hand 11.

Also, the slight frictional relative movement of the hub 22 and the inner vertical surface of the recess 34 provides a seal against dust and moisture which otherwise might accumulate in the annular space between the central spindle 31 and the inner surface of the hollow shaft 32. Still further the stability derived from the contact between the hub 22 and the shaft 32 permits a relatively large minute hand 11 having relatively large mass to be conventionally mounted on the shaft 32.

The hollow shaft 33 is rotatably disposed for concentric motion about the spindle 31 and the inside diameter of the shaft 33 is so chosen as not to contact the outer surface of the shaft 32. It will be noted that since there is no frictional contact between the hollow shafts 32 and 33 there is no annular seal corresponding to the seal provided between the hub 22 and the inner vertical surface of the recess 34. The shaft 33 carries an hour-indicating hand 12 mounted thereon near the top, in a conventional manner.

From the foregoing description it will be evident that the unique mounting of the disc member 13 fixedly disposed upon the collar 17 so as to provide differential rotational contact between the hub portion 22 of the collar, and the inner vertical recess of the hollow shaft 32, provides an unexpectedly effective and simple means for utilizing a second-indicating disc member of relatively large mass in a reliable and rugged manner.

Modifications, changes and improvements to the preferred forms of the invention herein disclosed, described and illustrated may occur to those skilled in the art who come to understand the principles and precepts thereof. Accordingly, the scope of the patent to be issued hereon should not be limited to the particular embodiments of the invention set forth herein, but rather should be limited by the advance by which the invention has promoted the art.

What is claimed is:

1. In a timepiece of the type having a rotatable first hollow shaft for referencing minutes and a rotatable second hollow shaft for referencing hours, each shaft concentrically disposed about a rotatable central shaft for referencing seconds wherein said first shaft carries a minute hand and said second shaft carries an hour hand each said hand operatively disposed above a stationary dial face having indiciae marked thereon to indicate time, and said second shaft is rotatable in annularly spaced apart relationship with said first shaft, the improvement comprising a hub means having an axial bore and a radially outwardly extending flange near one end thereof, a single transparent disc having a reference mark near the periphery thereof, said disc being affixed to said hub means in abutment against said flange said hub means being demountably disposed on said central shaft, a portion of the surface of said hub means being in slight frictional engagement with said first hollow shaft to seal the annular space between said central shaft and said first hollow shaft against finely divided dusty material and moisture.

2. The timepiece of claim 1 wherein said first hollow shaft is provided with a countersunk recess near the upper end of said first shaft so that a portion of the outer surface of said hub means is in slightly frictional engagement with the inner surface of said recess.

3. The timepiece of claim 2 wherein said disc is formed from a printable synthetic resinous material on which said reference mark is imprinted.

4. The timepiece of claim 3 wherein said reference mark has a pointed end.

* * * * *